US011564514B2

(12) United States Patent
Matsuno et al.

(10) Patent No.: US 11,564,514 B2
(45) Date of Patent: Jan. 31, 2023

(54) MODULAR CUPCAKE HOLDER SYSTEM AND METHOD

(71) Applicants: Rebecca Matsuno, Guttenberg, NJ (US); Andrea Kryszak, Guttenberg, NJ (US)

(72) Inventors: Rebecca Matsuno, Guttenberg, NJ (US); Andrea Kryszak, Guttenberg, NJ (US)

( * ) Notice: Subject to any disclaimer, the term of this patent is extended or adjusted under 35 U.S.C. 154(b) by 261 days.

(21) Appl. No.: 16/595,659

(22) Filed: Oct. 8, 2019

(65) Prior Publication Data

US 2020/0253398 A1 Aug. 13, 2020

Related U.S. Application Data

(60) Provisional application No. 62/804,103, filed on Feb. 11, 2019.

(51) Int. Cl.
*A47G 19/02* (2006.01)
*A47F 5/10* (2006.01)
*A47F 7/00* (2006.01)

(52) U.S. Cl.
CPC ..... *A47G 19/02* (2013.01); *A47F 5/108* (2013.01); *A47F 7/0071* (2013.01)

(58) Field of Classification Search
CPC ..... A47B 47/0025; A47B 47/0033; A47B 47/0041; A47B 47/005; A47B 47/0066; A47B 47/0091; A47B 47/042; A47B 47/047; A47F 5/108; A47F 7/0071; A47G 19/02; A47G 19/022; B65D 1/36; B65D 21/0201; B65D 21/0204; B65D 85/36
USPC ..... 248/146, 176.1, 346.03, 346.11, 558; 211/126.1, 126.2, 126.3, 126.4, 126.5; 220/23.2, 23.4; 206/557, 558
See application file for complete search history.

(56) References Cited

U.S. PATENT DOCUMENTS 2,006,938 A * 7/1935 Birkenhauer ..... A21B 3/132 249/120
3,131,829 A * 5/1964 Masser ..... B65D 21/0204 206/144
3,341,053 A * 9/1967 Keene ..... B65D 1/243 220/517
3,683,549 A * 8/1972 Simmon ..... A01G 9/027 47/86
3,800,974 A * 4/1974 Mogel ..... B43K 23/002 220/23.4
4,429,796 A * 2/1984 Sussman ..... B43M 99/008 206/558
4,452,419 A 6/1984 Saleeba
(Continued)

FOREIGN PATENT DOCUMENTS

CN 105836316 A * 8/2016 ..... B65D 11/00

*Primary Examiner* — Joshua E Rodden
(74) *Attorney, Agent, or Firm* — Inspired Idea Solutions Law Firm

(57) ABSTRACT

The modular cupcake holder system includes a series of hexagon shaped cupcake holders having a plurality of recessed areas (receivers) and pegs (extruded members) arranged on side portions of the cupcake holders. The pegs and plurality of recessed areas are configured on alternating side portions of the cupcake holders allowing the cupcake holders to be modularly connected to each other in a variety of designs, shapes, and letters.

20 Claims, 5 Drawing Sheets

(56) References Cited

U.S. PATENT DOCUMENTS

| | | | | | |
|---|---|---|---|---|---|
| 4,768,298 | A * | 9/1988 | Polhemus | B42D 5/006 | 220/23.4 |
| 4,944,400 | A * | 7/1990 | Van Onstein | B65D 21/0202 | 206/509 |
| 5,191,830 | A | 3/1993 | Jacobson | | |
| 5,224,594 | A * | 7/1993 | Hou | B43M 99/001 | 206/214 |
| 5,310,071 | A | 5/1994 | Rivlin et al. | | |
| 5,503,288 | A * | 4/1996 | Conconi | B65D 21/0204 | 220/23.4 |
| D403,558 | S | 1/1999 | Martinez | | |
| 7,424,958 | B1 * | 9/2008 | Eley | B25H 3/04 | 211/70.6 |
| 7,765,744 | B2 * | 8/2010 | Herron | F42D 5/045 | 52/79.5 |
| 8,469,222 | B1 | 6/2013 | Stavitzski et al. | | |
| 8,573,428 | B2 * | 11/2013 | Furuta | B62B 3/006 | 220/23.2 |
| 9,149,730 | B1 * | 10/2015 | Hauser | A63H 3/50 | |
| D850,201 | S * | 6/2019 | Omelchenko | D7/410 | |
| 10,420,419 | B2 * | 9/2019 | Kasravi | B42F 7/145 | |
| 2006/0113303 | A1 * | 6/2006 | Huruta | B65D 21/0204 | 220/23.4 |
| 2008/0283526 | A1 * | 11/2008 | Buchanan | B65D 21/0204 | 220/23.4 |
| 2009/0294392 | A1 * | 12/2009 | Stafford | A47F 5/10 | 211/153 |
| 2016/0367055 | A1 * | 12/2016 | Rausch | A47G 21/14 | |
| 2019/0313788 | A1 * | 10/2019 | Sheldon | F16B 5/07 | |
| 2020/0039689 | A1 * | 2/2020 | Leinbach | B65D 21/0204 | |

* cited by examiner

MODULAR CUPCAKE HOLDER SYSTEM AND METHOD

CROSS-REFERENCE TO RELATED APPLICATION(S)

The present application is related to and claims priority to U.S. Provisional Patent Application No. 62/804,103 filed Feb. 11, 2019, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of display trays and more specifically relates to cupcake or muffin display trays.

RELATED ART

Deserts are provided at many events and parties. In the field of arranging of food products for service, such as at parties and the like, methods and means have been used for the display of individual baked goods and desserts such as cakes and cupcakes. One type of dessert display holder is a flat metal pan or tray, usually rectangular in shape. However, a need exists for a modular tray and means for displaying desserts such as cupcakes and muffins. Therefore, a suitable solution is desired.

U.S. Pat. No. 5,310,071 to Eitan Rivlin et al. relates to a dual-purpose food container/building block element. The described dual-purpose food container/building block element is a dual-purpose sealable food container/building block element comprising an upper portion and a bottom portion, the upper portion being open, characterized in that at least one of the upper portion and the bottom portion is provided with at least one connecting member, such that a plurality of the container/elements are connectable to one another by engaging the connecting members and sliding toward each other along the connecting members, for use of the container/elements as a toy after completing original use as a food container. By assembling a plurality of food containers in the play mode, three-dimensional structures may be created. In order to enable such large constructions to be firm and steady, the connecting members are of the slide type, engageable by insertion of rails at the open ends of sockets and sliding longitudinally into each other, perpendicular to the forces acting on assembled building blocks. This type of connection does not depend on friction as the main holding force, and is not easily separated.

SUMMARY OF THE INVENTION

The present invention advantageously fills the aforementioned deficiencies by providing modular cupcake holders which may be custom arranged in a variety of designs, shapes, and letters. The present invention is superior to other systems in that it effectively displays cupcakes and muffins and the like in a user-selected design.

A modular cupcake holder system which preferably comprises a series of hexagon shaped cupcake holders designed to be interlocked is disclosed herein. Each of the hexagon shaped cupcake holders may include a plurality of recessed areas (receivers) arranged on at least three side portions of the cupcake holder and pegs positioned on the remaining three side portions of the cupcake holder. The plurality of recessed areas and pegs are arranged on alternating side portions of the cupcake holders. The pegs may fasten to the recesses, enabling the holders to be interlocked when a side portion having pegs is mated (removably coupled) to a side portion having recesses. The modular cupcake holder system may be useful for providing modular cupcake holders which can be arranged in a variety of esthetic designs, shapes, and letters.

A modular cupcake holder system is enabled herein in a preferred embodiment, the system comprising: a plurality of cupcake holders configured to be able to be modularly coupled and uncoupled (as per the desire of the user), each of the plurality of cupcake holders having a body defined by and comprising a top surface configured as a cupcake-receiver for display of a cupcake thereon, a bottom surface, a plurality of side-surfaces, a plurality of extruded members, and a plurality of receivers. The plurality of extruded members and the plurality of receivers are alternately located on the plurality of side-surfaces (respectively on each respective second side-surface to allow for efficient coupling); wherein coupled engagement between the plurality of cupcake holders is enabled when the plurality of extruded members and the plurality of receivers couplingly engage as per user manipulation. The plurality of cupcake holders is configured to be able to be modularly coupled and uncoupled, each of the plurality of cupcake holders is able to support one of the cupcakes for modular-display. The plurality of side-surfaces comprises exactly six of the side-surfaces in preferred embodiments (other shapes are envisioned, with more or less sides). The body is effectively a 3D hexagon in these embodiments. Each of the plurality of extruded members preferably comprise a knob and each of the plurality of receivers comprise a spherical hole (negative volume) each able to receivingly accept a corresponding knob. Each of the plurality of receivers comprises a female-coupling; each of the plurality of extruded members comprises a male-coupling. Other fastening means may be used. The knobs and receivers are suitable flexible for ease of assembly and disassembly.

In preferred embodiments the plurality of extruded members comprises three of the extruded members located on each alternating side-surface for a total of nine extruded members; and in a similar fashion the plurality of receivers comprises three of the receivers located on each alternating side-surface for a total of nine receivers. As such each of the plurality of cupcake holders are configured to be able to be modularly coupled and uncoupled to and from an adjacent cupcake holder for use/non-use conditions. The top surface comprises a raised ring and/or a raised rim to limit excessive movement of the cupcake so that the cupcake remains substantially stationary during display. The modular-display of the cupcakes on the modular cupcake holder system is able to be formed in a user-preferred orientation.

A method of use for the modular cupcake holder system is also discussed herein, the method comprising the steps of: providing a plurality of cupcake holders configured to be able to be modularly coupled and uncoupled, each of the plurality of cupcake holders having a body defined by a top surface configured as a cupcake-receiver for display of a cupcake thereon, a bottom surface, a plurality of side-surfaces, a plurality of extruded members, and a plurality of receivers; wherein the plurality of cupcake holders is configured to be able to be modularly coupled and uncoupled, each of the plurality of cupcake holders able to support one of the cupcakes for modular-display; coupling the plurality of cupcake holders in a user-preferred orientation via modularly connecting adjacent cupcake holders by male and female connectable-coupling; and placing the cupcakes on display on the formed modular cupcake holder system. The method may further comprise the step of: rearranging said modular-display.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a modular cupcake holder system, constructed and operative according to the teachings of the present disclosure.

The various embodiments of the present invention will hereinafter be described in conjunction with the appended drawings, wherein like designations denote like elements.

DETAILED DESCRIPTION

Figure 1:
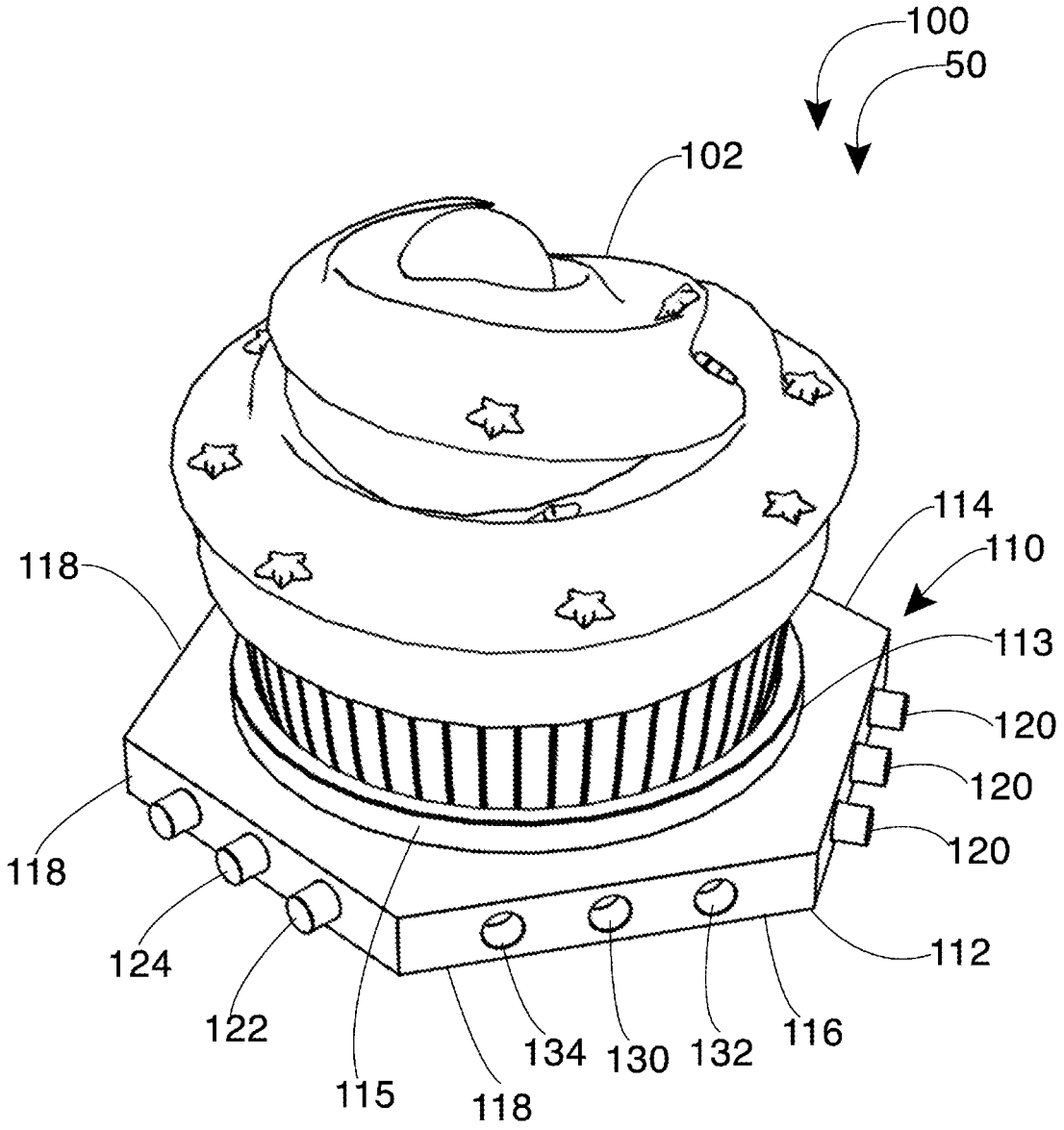
FIG. 1 is a perspective view of the modular cupcake holder system during an 'in-use' condition (cupcake being displayed), according to an embodiment of the disclosure.
Figure 2:
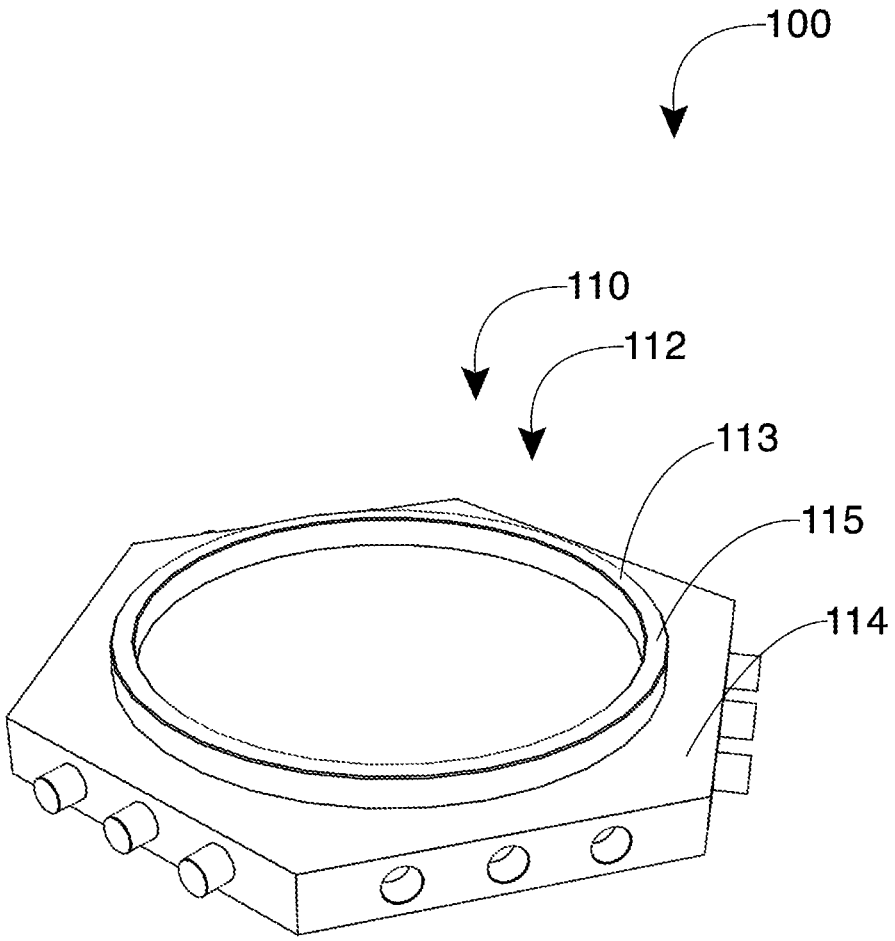
FIG. 2 is a perspective view of the modular cupcake holder system of FIG. 1, according to an embodiment of the present disclosure.
Figure 3:
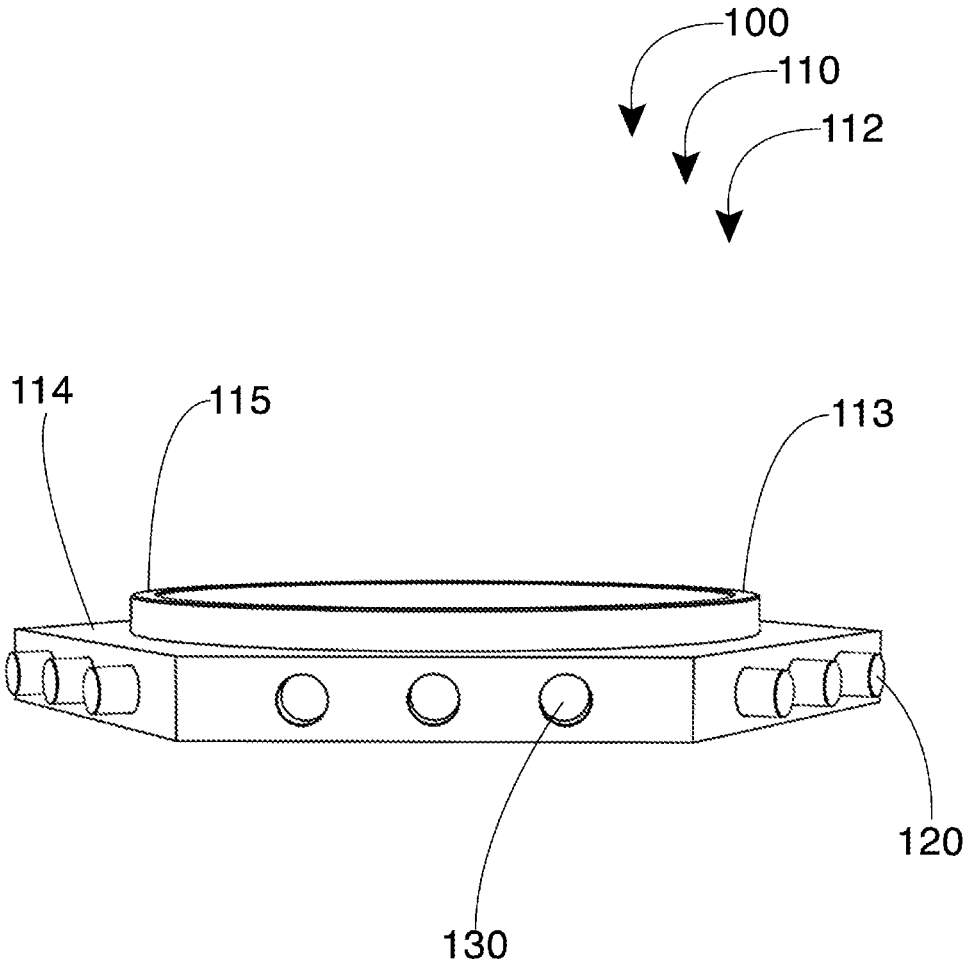
FIG. 3 is a perspective view of the modular cupcake holder system of FIG. 1, according to an embodiment of the present disclosure.
Figure 4:
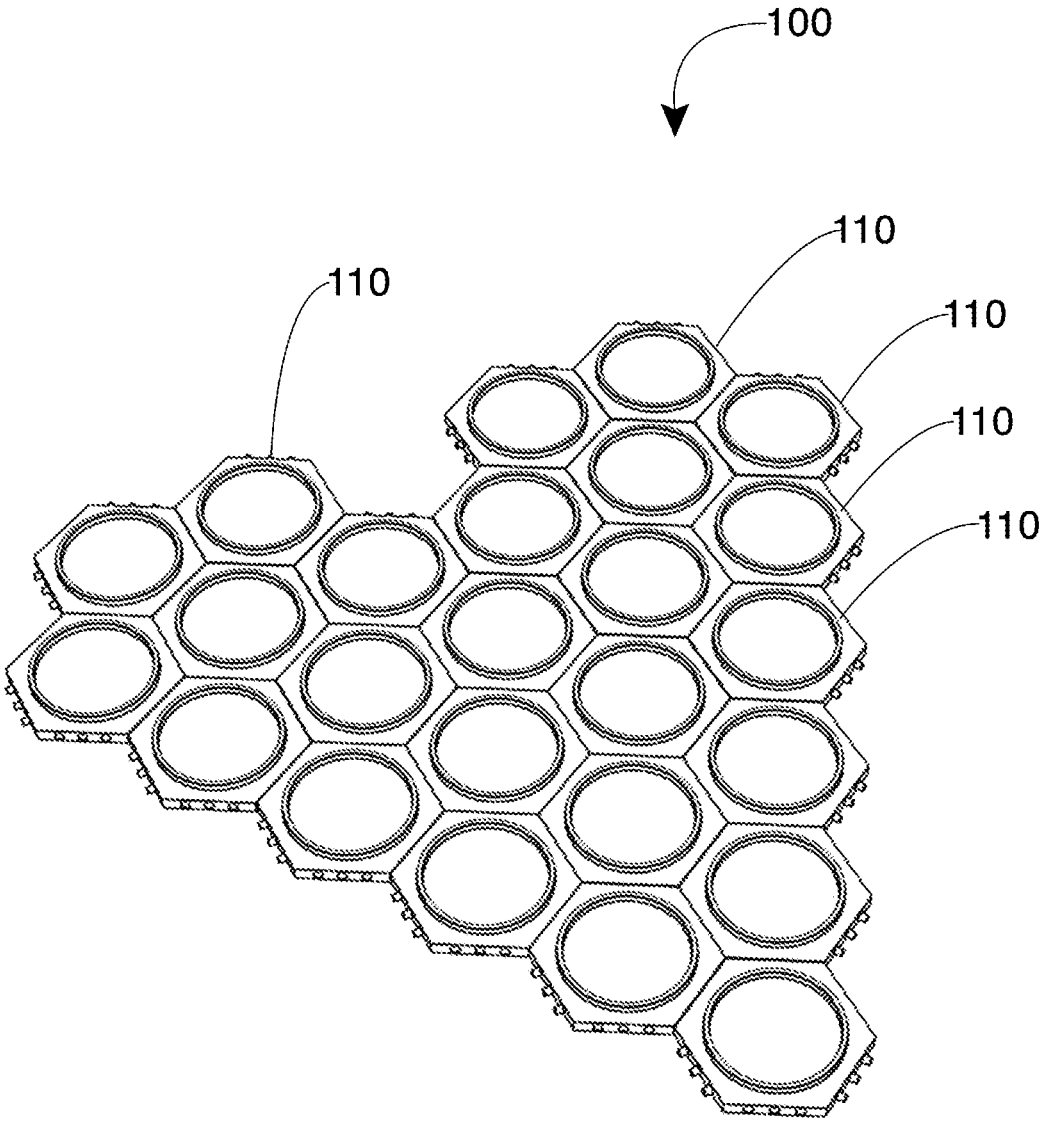
FIG. 4 is a perspective view of the modular cupcake holder system of FIG. 1, according to an embodiment of the present disclosure.
Figure 5:
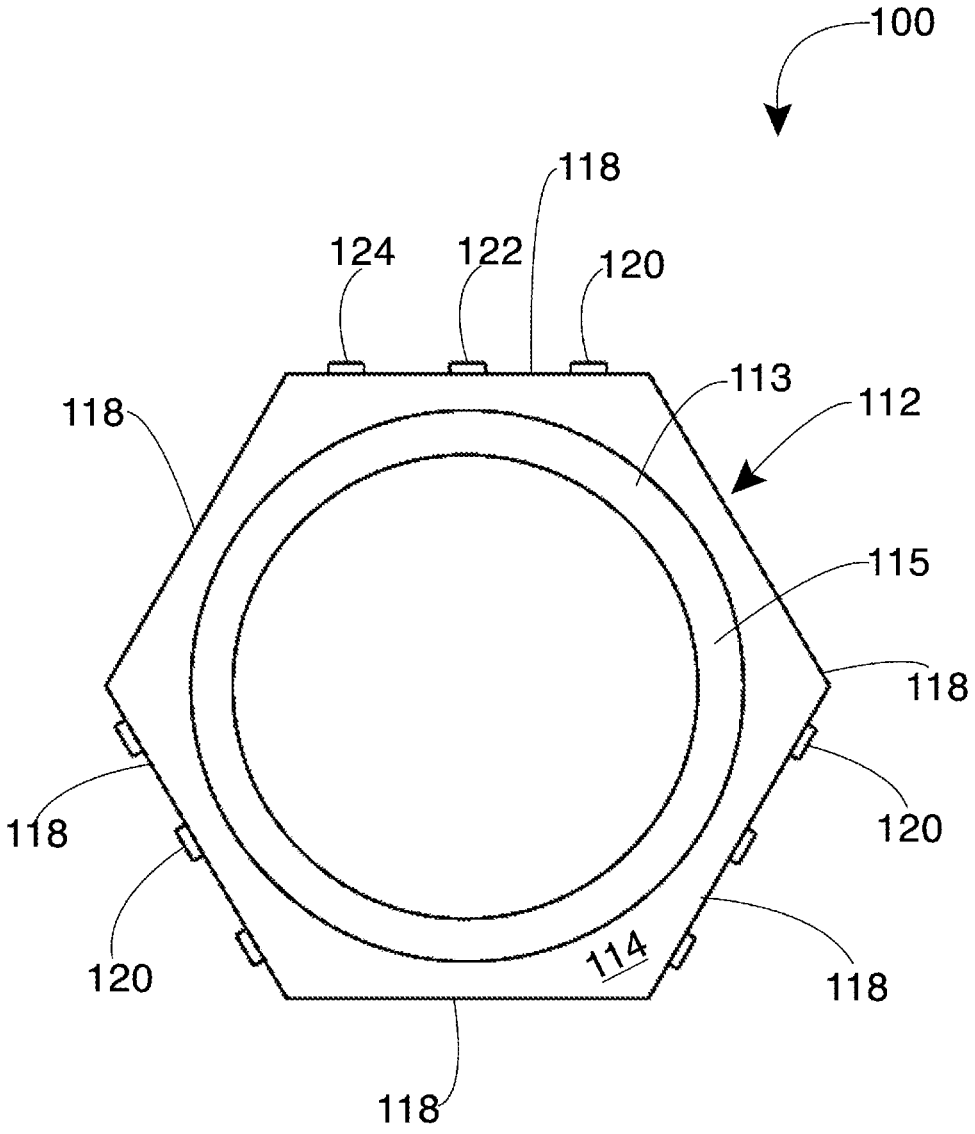
FIG. 5 is another perspective view of the modular cupcake holder system of FIG. 1, according to an embodiment of the present disclosure.

As discussed above, embodiments of the present disclosure relate to a cupcake holding means and more particularly to a modular cupcake holder system as used to improve the display (functional-utility and esthetics) of cupcakes via providing a modular means.

Generally, the modular cupcake holder system is a hexagon shaped cupcake holder. The modular cupcake holder system may be useful for providing modular cupcake holders which may be arranged in a variety of designs, shapes, and letters. The device may comprise a series of hexagon shaped cupcake holders having a plurality of recessed areas and pegs (extruded members) arranged on side portions of the cupcake holders. The recessed areas (receivers) may be configured to mate one cupcake holder to another when interlocked with respective pegs that go into the recessed areas located on another cupcake holder. The cupcake holders may be interlocked and arranged in a user-selected design.

The hexagon shaped cupcake holder has the recessed areas arranged on at least three side portions of the cupcake holder and pegs positioned on the remaining three side portions of the cupcake holder. The sides have the pegs and the recesses alternating around the outer edge of the holder. Using the plurality of recessed areas and pegs, the user may interlock the cupcake holders and create unique cupcake display designs. Patterns may be supplied, or the user may create his or her own design. Since the pegs and plurality of recessed areas may be configured on alternating side portions of the cupcake holders this allows the cupcake holders to be connected to each other in patterns of lines or solid areas. The cupcake holders may be connected by pressing the corresponding pegs into the plurality of recessed areas. In some embodiments, additional mechanical features to enable positive interlocking and retention may be provided. A ridge around the cupcake holder may keep the cupcake in place. The hexagon shaped cupcake holders may further be comprised of plastic or other suitable materials. Preferably, the holders may each be substantially planar, having both a top hexagonal face and a bottom hexagonal face. Circular recesses for cupcakes may be provided in either or both faces such that they are stackable during non-use. In some embodiments, the recesses may include circular flanges protruding above the face.

The modular cupcake holder system is able to be assembled in various shapes and designs, there are shown exemplary patterns of numbers for birthdays, hearts, Christmas trees, and other designs which may be created. The patterns may correspond to specific events or holidays. The modular cupcake holder system may include a pattern guide with supplied patterns for the user. Alternatively, the user can create their own patterns to use. Once the patterns have been created, the user can flip them over as a whole onto a tray and place the cupcakes or muffins onto the cupcake holders such that they can be moved to a desired location.

Referring now more specifically to the drawings by numerals of reference, there is shown in FIGS. 1-5, various views of a modular cupcake holder system 100.

FIG. 1 shows a modular cupcake holder system 100 during an 'in-use' condition 50, according to an embodiment of the present disclosure. Here, the modular cupcake holder system 100 may be beneficial for use by a user to creatively and esthetically display cupcakes. As illustrated, the modular cupcake holder system 100 may include a plurality of cupcake holders 110 configured to be able to be modularly coupled and uncoupled, each of the plurality of cupcake holders 110 having a body 112 defined by a top surface 114 configured as a cupcake-receiver for display of a cupcake 102 thereon, a bottom surface 116, a plurality of side-surfaces 118 (surfaces generally referred to herein as would be oriented in an in-use condition 50), a plurality of extruded members 120, and a plurality of receivers 130.

Referring now to FIGS. 2-5, the plurality of extruded members 120 and the plurality of receivers 130 are alternately located on the plurality of side-surfaces 118 as previously mentioned. Coupled engagement between the plurality of cupcake holders 110 is enabled when the plurality of extruded members 120 and the plurality of receivers 130 couplingly engage. As such the plurality of cupcake holders 110 as modular cupcake holder system 100 is configured to be able to be modularly coupled and uncoupled at will; each of the plurality of cupcake holders 110 able to support one of the cupcakes 102 for modular-display. The modular-display can take almost limited form essentially limited only by space and creativity.

The plurality of side-surfaces 118 comprises exactly six of the side-surfaces 118 in preferred embodiments; wherein the body 112 is a 3D hexagon. The top surface 114 comprises a raised rim 115 and/or a raised ring 113. The top surface 114 may comprise a concave-dish or a non-concave-dish (flat; convex or other suitable surface for mounting a cupcake 102 on in a suitable stable condition for a display duration). the plurality of cupcake holders 110 may be stackable. The bottom surface 116 may be substantially planar or cupped to facilitate stacking.

Each of the plurality of extruded members 120 preferably comprise a knob 122 and each of the plurality of receivers 130 preferably comprise a spherical hole 132 each able to receivingly accept a corresponding knob 122. Each of the plurality of receivers 130 of the modular cupcake holder system 100 comprises a female-coupling 134 and each of the plurality of extruded members 120 (pegs) comprises a male-coupling 124. The plurality of extruded members 120 preferably comprises three of the extruded members 120 located on each alternating side-surface 118 for a total of nine extruded members 120 in preferred embodiments. Likewise the plurality of receivers 130 comprises three of the receivers 130 located on each alternating side-surface 118 for a total of nine receivers 130. As designed each of the plurality of cupcake holders 110 are configured to be able to be modularly coupled and uncoupled to and from an adjacent cupcake holder 110. Upon reading this specification, it should be appreciated that, under appropriate circumstances, considering such issues as user preferences, design preference, structural requirements, marketing preferences, cost, available materials, technological advances, etc., other extruded members and receiver arrangements such as, for example, clickable versions, coupled by other suitably equivalent means, etc., may be sufficient.

According to one embodiment, the modular cupcake holder system 100 may be arranged as a kit. In particular, the modular cupcake holder system 100 may further include a set of instructions. The instructions may detail functional relationships in relation to the structure of the modular cupcake holder system 100 such that the modular cupcake holder system 100 can be used, maintained, or the like, in a preferred manner.

A method for using the modular cupcake holder system 100 may include one or more components or features of the modular cupcake holder system 100 as described above. As illustrated, the method for use of the modular cupcake holder system 100 may include the steps of: step one, providing a plurality of cupcake holders configured to be able to be modularly coupled and uncoupled, (each of the plurality of cupcake holders having a body defined by a top surface configured as a cupcake-receiver for display of a cupcake thereon, a bottom surface, a plurality of side-surfaces, a plurality of extruded members, and a plurality of receivers); wherein the plurality of cupcake holders is configured to be able to be modularly coupled and uncoupled, each of the plurality of cupcake holders able to support one of the cupcakes for modular-display; step two coupling the plurality of cupcake holders in a user-preferred orientation via modularly connecting adjacent the cupcake holders by male and female connectable-coupling; and step three placing the cupcakes on display on the formed modular cupcake holder system. The method may further comprise the step four of: rearranging the modular-display. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for display, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A modular cupcake holder system, the system comprising:

a plurality of cupcake holders configured to be able to be modularly coupled and uncoupled, each of said plurality of cupcake holders having;

a body defined by a top surface configured as a cupcake-receiver for display of a cupcake thereon, a bottom surface, a plurality of side-surfaces, a plurality of extruded members, and a plurality of receivers;

wherein said plurality of side-surfaces is configured with only one or more of the plurality of extruded members or one or more of the plurality of receivers;

wherein said plurality of extruded members and said plurality of receivers are alternately located on said plurality of side-surfaces;

wherein said plurality of extruded members comprises at least three of said extruded members located on each alternating said side-surface;

wherein coupled engagement between said plurality of cupcake holders is enabled when said plurality of extruded members and said plurality of receivers couplingly engage; and wherein said plurality of cupcake holders is configured to be able to be modularly coupled and uncoupled, each of said plurality of cupcake holders able to support one of said cupcakes for prominent display around the plurality of cupcake holders.

2. The modular cupcake holder system of claim 1, wherein said plurality of side-surfaces comprises exactly six of said side-surfaces.

3. The modular cupcake holder system of claim 2, wherein said body is a 3D hexagon.

4. The modular cupcake holder system of claim 1, wherein said top surface comprises a raised rim.

5. The modular cupcake holder system of claim 1, wherein each of the plurality of extruded members comprise a knob.

6. The modular cupcake holder system of claim 5, wherein each of the plurality of receivers comprise a cylindrical hole each able to receivingly accept a corresponding said knob.

7. The modular cupcake holder system of claim 6, wherein each of the plurality of receivers comprises a female-coupling.

8. The modular cupcake holder system of claim 5, wherein each of the plurality of extruded members comprises a male-coupling.

9. The modular cupcake holder system of claim 1, wherein said top surface comprises a raised ring.

10. The modular cupcake holder system of claim 1, wherein the bottom surface is planar.

11. The modular cupcake holder system of claim 3, wherein said plurality of extruded members comprises a total of nine said extruded members.

12. The modular cupcake holder system of claim 3, wherein said plurality of receivers comprises three of said receivers located on each alternating said side-surface for a total of nine said receivers.

13. The modular cupcake holder system of claim 1, wherein each of the plurality of cupcake holders are configured to be able to be modularly coupled and uncoupled to and from an adjacent said cupcake holder.

14. The modular cupcake holder system of claim 1, wherein the top surface comprises a concave-dish.

15. The modular cupcake holder system of claim 1, wherein said top surface comprises a non-concave-dish.

16. The modular cupcake holder system of claim 1, wherein the plurality of cupcake holders are stackable.

17. A modular cupcake holder system, the system comprising:

a plurality of cupcake holders configured to be able to be modularly coupled and uncoupled, each of said plurality of cupcake holders having;

a body defined by and comprising a top surface configured as a cupcake-receiver for display of a cupcake thereon, a bottom surface, a plurality of side-surfaces, a plurality of extruded members, and a plurality of receivers;

wherein said plurality of side-surfaces is configured with only one or more of the plurality of extruded members or one or more of the plurality of receivers;

wherein said plurality of extruded members and said plurality of receivers are alternately located on said plurality of side-surfaces;

wherein said plurality of extruded members comprises at least three of said extruded members located on each alternating said side-surface;

wherein coupled engagement between said plurality of cupcake holders is enabled when said plurality of extruded members and said plurality of receivers couplingly engage;

wherein said plurality of cupcake holders is configured to be able to be modularly coupled and uncoupled, each of said plurality of cupcake holders able to support one of said cupcakes for prominent display around the plurality of cupcake holders;

wherein said plurality of side-surfaces comprises exactly six of said side-surfaces;

wherein said body is a 3D hexagon;

wherein each of the plurality of extruded members comprise a knob;

wherein each of the plurality of receivers comprise a spherical hole each able to receivingly accept a corresponding said knob;

wherein each of the plurality of receivers comprises a female-coupling;

wherein each of the plurality of extruded members comprises a male-coupling;

wherein said plurality of extruded members comprises three of said extruded members located on each alternating said side-surface for a total of nine said extruded members;

wherein said plurality of receivers comprises three of said receivers located on each alternating said side-surface for a total of nine said receivers;

wherein each of the plurality of cupcake holders are configured to be able to be modularly coupled and uncoupled to and from an adjacent said cupcake holder;

wherein said top surface comprises a raised ring to limit excessive movement of said cupcake;

wherein said modular-display of said cupcakes on said modular cupcake holder system is able to be formed in a user-preferred orientation.

18. The modular cupcake holder system of claim 17, further comprising set of instructions; and wherein the modular cupcake holder system is arranged as a kit.

19. A method of use for a modular cupcake holder system, the method comprising the steps of:

providing a plurality of cupcake holders configured to be able to be modularly coupled and uncoupled, each of said plurality of cupcake holders having;

a body defined by a top surface configured as a cupcake-receiver for display of cupcakes thereon, a bottom surface, a plurality of side-surfaces, a plurality of extruded members, and a plurality of receivers;

wherein said plurality of side-surfaces is configured with only one or more of the plurality of extruded members or one or more of the plurality of receivers;

wherein said plurality of extruded members and said plurality of receivers are alternately located on said plurality of side-surfaces;

wherein said plurality of extruded members comprises at least three of said extruded members located on each alternating said side-surface;

wherein coupled engagement between said plurality of cupcake holders is enabled when said plurality of extruded members and said plurality of receivers couplingly engage;

wherein said plurality of cupcake holders is configured to be able to be modularly coupled and uncoupled, each of said plurality of cupcake holders able to support cupcakes for prominent display around the plurality of cupcake holders;

coupling said plurality of cupcake holders in a user-preferred orientation via modularly connecting adjacent said cupcake holders by corresponding extruded members and receivers in a connected coupling; and placing said cupcakes on display on formed said modular cupcake holder system.

20. The method of claim 19, further comprising the step of: rearranging said modular display.

* * * * *